US005701130A

United States Patent [19]

Thill et al.

[11] Patent Number: 5,701,130

[45] Date of Patent: Dec. 23, 1997

[54] SELF PHASED ANTENNA ELEMENT WITH DIELECTRIC AND ASSOCIATED METHOD

[75] Inventors: Kevin Michael Thill, Kenosha, Wis.; Dwight David Walthers, McHenry, Ill.

[73] Assignee: Motorola, Inc., Schaumburg, Ill.

[21] Appl. No.: 840,437

[22] Filed: Mar. 31, 1997

Related U.S. Application Data

[63] Continuation of Ser. No. 414,155, Mar. 31, 1995, abandoned.

[51] Int. Cl.[6] ..... H01Q 1/36

[52] U.S. Cl. ..... 343/895; 343/742; 343/872

[58] Field of Search ..... 343/895, 872, 343/873, 893, 742, 867, 802, 807; H01Q 1/36

[56] References Cited

U.S. PATENT DOCUMENTS

| | | | |
|---|---|---|---|
| 3,828,353 | 8/1974 | Majkrzak et al. | 343/873 |
| 4,697,192 | 9/1987 | Hofer et al. | 343/895 |
| 5,406,693 | 4/1995 | Egashira et al. | 343/895 |

FOREIGN PATENT DOCUMENTS 2 292 257 A 2/1996 United Kingdom .

2 292 638 A 2/1996 United Kingdom .

OTHER PUBLICATIONS

"Spacecraft Antennas", Chapter 20, American Radio Relay League, pp. 20–1 to 20–7.

A. Kumar, *Fixed and Mobile Terminal Antennas,* Chapter 5, Artech House, Inc., 1991, pp. 163–236.

*Primary Examiner*—Michael C. Wimer

*Attorney, Agent, or Firm*—Daniel W. Juffernbruch

[57] ABSTRACT

A self phased antenna element with two pairs of arms (110, 120, 130, 140) in a crossed relationship transceives a signal at a resonant frequency. A dielectric (150, 160) is disposed adjacent an arm (130, 140) to obtain a self phased relationship in the arms (110, 120, 130, 140) at the resonant frequency. The arms can form crossed loops or twisted crossed loops such as a quadrifilar helix antenna element. A dielectric collar on arms of the same loop causes arm currents to be equally spaced from one another. The antenna size is reduced and a cross section of the antenna element appears circular without degradation of a gain pattern when the dielectric is used on the certain arm.

14 Claims, 6 Drawing Sheets

SELF PHASED ANTENNA ELEMENT WITH DIELECTRIC AND ASSOCIATED METHOD

This is a continuation of application Ser. No. 08/414,155, filed Mar. 31, 1995 and now abandoned.

BACKGROUND OF THE INVENTION

1. Technical Field of the Invention

The invention is directed towards antenna elements and, more particularly, is directed towards antenna elements that are self phased using a dielectric.

2. Description of the Related Art

Many antennas have antenna elements made of pairs of arms. In crossed loop or quadrifilar helix antenna elements, a pair of arms forms a loop and two loops are crossed at 90 degrees. Known quadrifilar helix antennas typically have two crossed loops of different lengths. The two loops are twisted to form quarter-wave volutes, half-wave volutes, three-quarter-wave volutes or full-wave volutes. Other configurations of arms that produce circularly-polarized radiation patterns are also within the art.

The two loops of the quadrifilar helix antenna radiate with circular polarization when the antenna is self phased. In the art, quadrifilar helix antennas or crossed loop antennas are self phased when one of the loops is larger relative to the desired resonant frequency. The larger loop appears capacitive and has a positive imaginary component, and the smaller loop is inductive and has a negative imaginary component. Ideally, when the antenna element is self-phased, the capacitive and inductive components (imaginary components) cancel, and the antenna appears purely resistive. This self-phased antenna thus obtain quadrature or 90 degree phase difference between currents in the loops, thus producing a self phased and circularly polarized current relationship therein.

A problem with the quadrifilar helix antenna elements and the crossed loop antenna elements is that the orthogonal loops are designed such that the antenna elements are wider in one direction than in the other direction. The antenna elements are wider in one direction than in the other direction because one loop is larger than the other. Preferably, the antenna element is shaped as narrow as possible and formed as thinly as possible. Usually, the larger loop causes the antenna to have a width approximately fifteen percent larger in one direction than the other. Such a larger loop causes the cross-section of a crossed loop antenna or a quadrifilar helix antenna to have an oval cross-section, rather than a smaller and more aesthetically pleasing circular cross-section. The present invention allows the antenna size to be reduced by providing a smaller cross-section of an ideally circular shape.

The size of antennas has been reduced in the art by narrowing or shortening the overall dimensions of an antenna. One might try reducing the respective sizes of the two loops of a quadrifilar helix antenna such that the loops have the same size. Altering the respective dimensions of arms within an antenna, however, distorts the gain pattern of the antenna. Creating a smaller looking antenna by reducing the antenna's dimensions, also reduces the antenna's gain by a few or more decibels. In a device such as a low-power, portable satellite transceiver for communicating with non-geosynchronus satellites, a uniform and low-loss antenna gain pattern is important. Small size, particularly in diameter, is also desired to improve portability and user desirability. The present invention reduces antenna size while maintaining a desired gain pattern not heretofore possible without the oval cross-section of the known crossed loop or quadrifilar helix antennas.

Antennas having multiple arms are also difficult to manufacture with accuracy. Special fixtures are needed during the manufacturing process when soldering arms together to form the antenna element. The arms must be perfectly dimensioned to provide an ideal gain pattern with minimum loss. Further, techniques for improving accuracy of multiple-armed antennas are desired. Techniques for reducing or eliminating special fixtures during assembly of multiple-armed antennas are additionally needed.

DETAILED DESCRIPTION OF THE PREFERRED EMBODIMENTS

Figure 1:
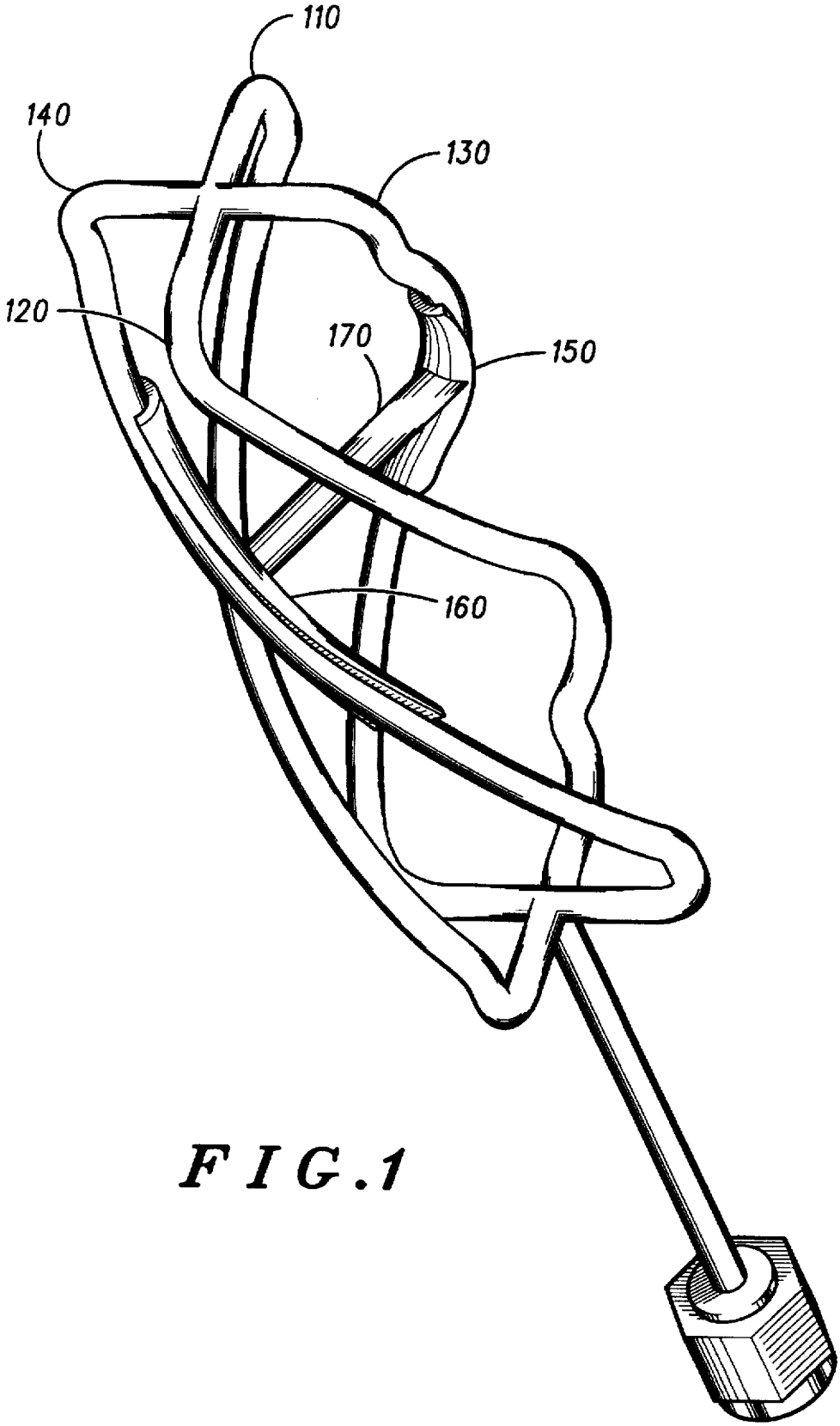
FIG. 1 illustrates a perspective view of a quadrifilar helix antenna element with dielectric according to the present invention.

FIG. 1 illustrates a perspective view of a quadrifilar helix antenna element with dielectric according to the present invention. The quadrifilar helix antenna element has four arms 110, 120, 130 and 140. A first pair of the arms 110 and 120 forms a first loop and a second pair of the arms 130 and 140 forms a second loop. Dielectric members 150 and 160 are adjacent to the arms of one of the two loops of the quadrifilar helix antenna element. The dielectric 150 or 160 is preferably formed in the shape of a collar wrapped around an arm of the loop. The collar can completely encapsulate an arm and form a sleeve. The collar preferably partially-encapsulates the arm. When the dielectric collar partially encapsulates the arm, the dielectric material preferably faces an inside of the loop as illustrated. When the dielectric material faces an inside of the loop, exterior dimensions are further reduced and an even smaller cross-sectional size of the antenna element is provided.

Dimensions of the dielectric such as length, thickness, width and amount of encapsulation affect the phasing of currents in the associated loop or arm. Further, the type of dielectric material is preferably a plastic material often used in injection molded processes. The type of dielectric material will affect the phasing of currents in the associated loop or arm. The number of dielectric members will also affect the phasing of currents in the associated loop or arm. Should the dielectric member be formed by a process other than injection molding, other materials are known to be capable of producing a suitable dielectric property.

During manufacturing or assembly of an antenna element, the dielectric collar of FIG. 1 can merely be slid up and down along an arm to trim or slightly adjust the phasing of currents in the associated arm. Although less preferred, the length of a chosen dielectric material could also be shortened during manufacture to adjust the phasing of currents. Besides reducing antenna size and cross-sectional diameter, the present invention provides a simple mechanism for tuning the antenna.

Although the antenna element can be self phased and its size reduced using only one dielectric member adjacent to one arm, two dielectric collars 150 and 160 are preferably disposed on two respective arms. By using two dielectric collars on two respective arms, a truss member 170 can support the arms 130 and 140 between the collars 150 and 160. The support by the truss member 170 absorbs compression forces between the arms. Multiple truss members 170 or a continuous piece of dielectric can also be used for support between arms. Through use of a truss member 170 for support between arms, the truss member supports the arms during soldering. Special fixtures used to maintain positioning of the arms during assembly are thus avoided.

A quadrifilar helix antenna element or a crossed loop antenna element according to the present invention has two crossed loops of the same size. When one of these same size loops has the dielectric material, it becomes more inductive than the other loop. Thus when both loops are capacitive without the dielectric, adding the dielectric to one loop makes the one loop inductive. When an appropriate amount and type of dielectric is added along an appropriate position, the capacitive and inductive components will cancel and the antenna element will appear purely resistive. Self phasing of the antenna element at the resonant frequency is thus achieved.

Figure 2:
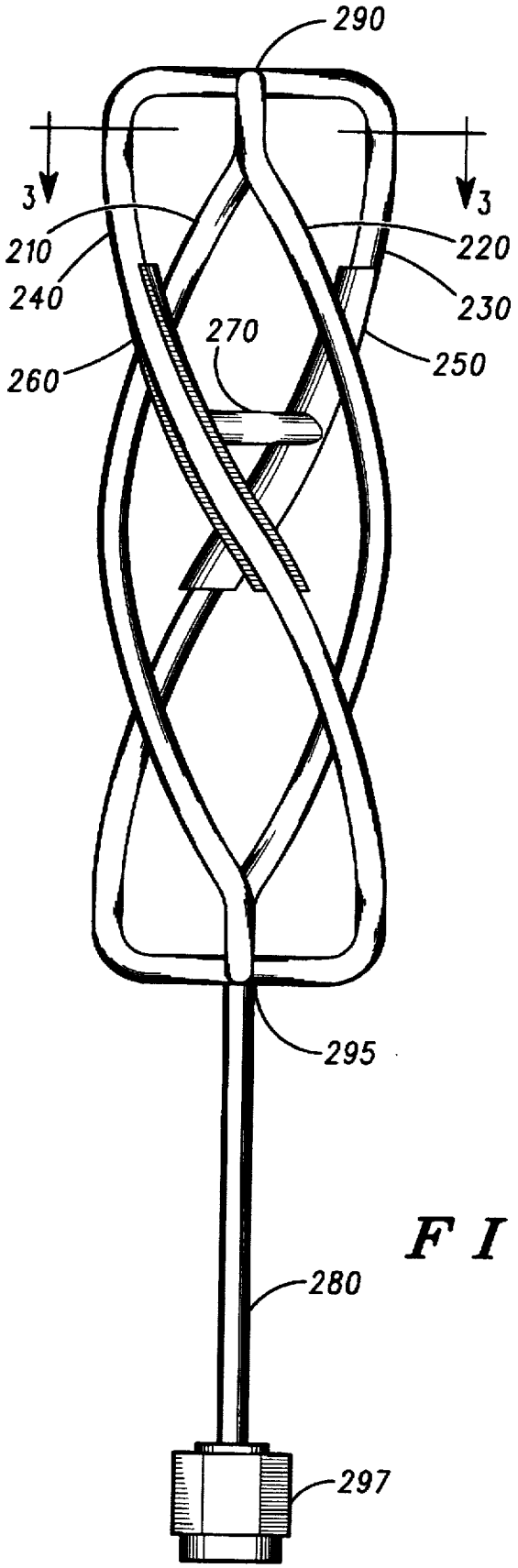
FIG. 2 illustrates a side view of the quadrifilar helix antenna element with dielectric according to the present invention.

FIG. 2 illustrates a side view of the quadrifilar helix antenna element according to the present invention. A feed line 280 preferably is a semi-rigid coaxial transmission line having an inner conductor shielded by an outer copper tube. The feed line 280 will extend through one of the arms to a feed point of excitation at the top 290 of the quadrifilar helix element. At the feed point of excitation, the feed current will emerge from the coaxial cable or coaxial tubing and attach to an outer conductive surface of the arms. The feed point of excitation can alternatively be at the bottom 295. A coupling nut 297 is used to connect the feed line 280. Different forms of coupling and different lengths of the feed line 280 can be chosen without effecting radiating characteristics or a gain pattern of the antenna element. The overall construction of a quadrifilar helix or crossed loop antenna type element is known to those of skill in the art.

Figure 3:
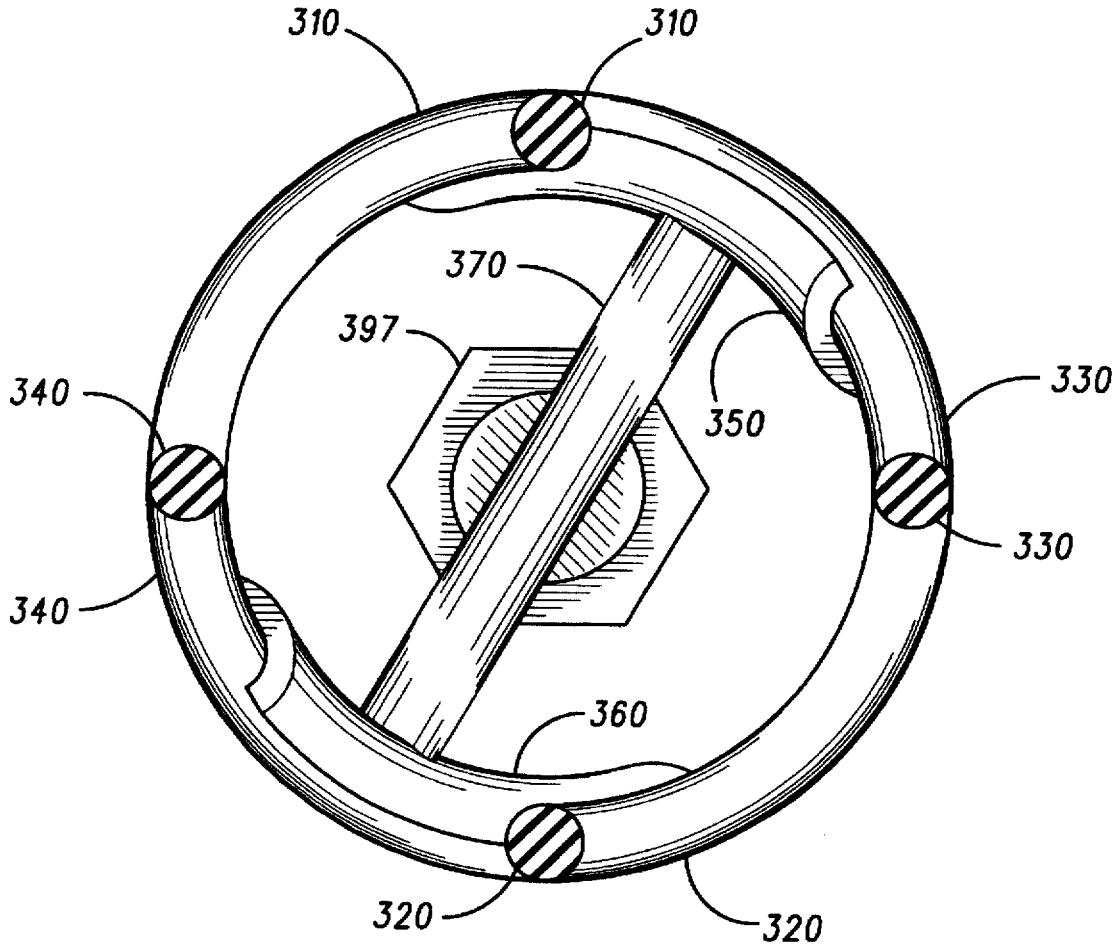
FIG. 3 illustrates a cross-section of the quadrifilar helix antenna element with dielectric of FIG. 2 according to the present invention.

FIG. 3 illustrates a cross-section of the quadrifilar helix antenna element of FIG. 2. In FIG. 3, a downwardly looking view of the twisted arms 310, 320, 330, and 340 is shown. The partially-encapsulating dielectric collars 350 and 360 are supported by truss member 370. The coupling nut 397 is also illustrated.

Figure 4:
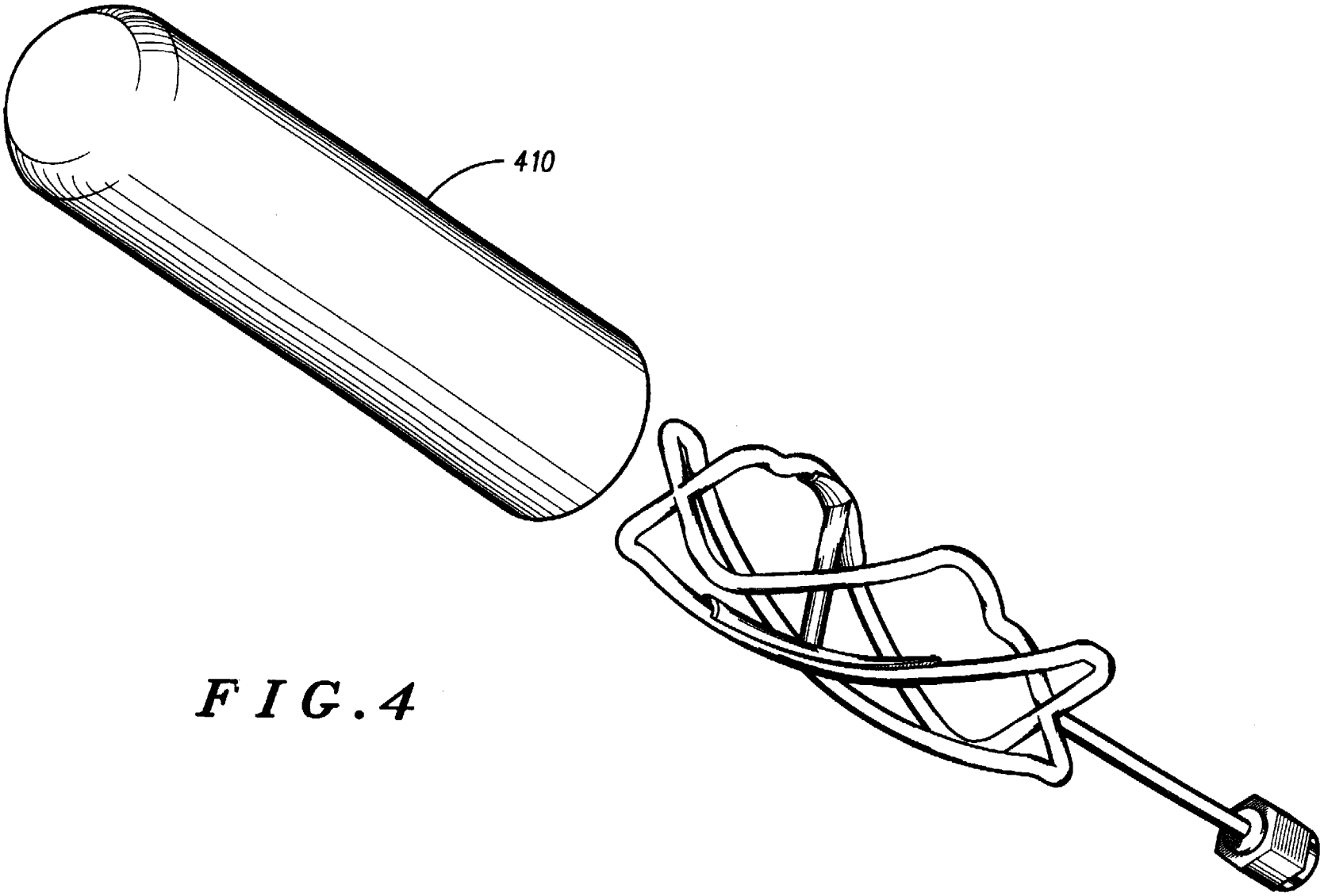
FIG. 4 illustrates a radome for housing the antenna element with dielectric according to the present invention.

FIG. 4 illustrates a radome 410 for housing the antenna element with dielectric according to the present invention. The radome 410 covers the exterior of the antenna element to physically house the delicate arm structures. To reduce cross-sectional diameter of the antenna element, the radome 410 has as small a diameter as practical. A type of material for the radome having hard and lightweight properties is preferred.

Figure 5:
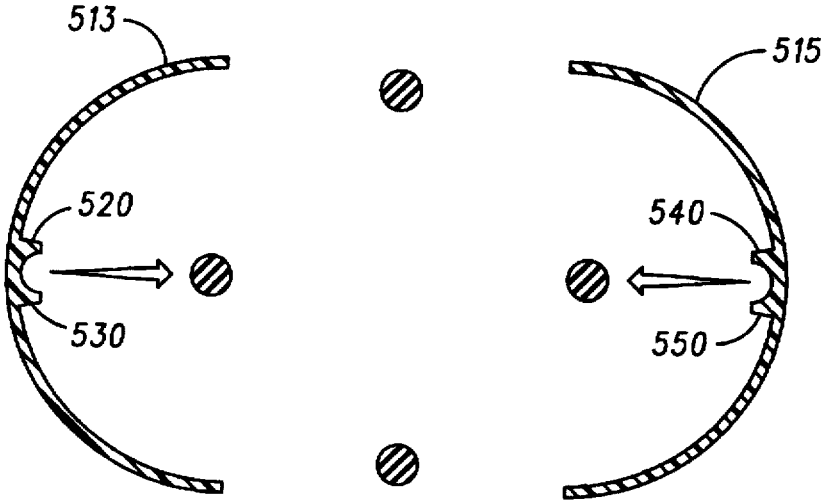
FIGS. 5–7 illustrate an alternative embodiment for housing the antenna element according to the present invention.
Figure 6:
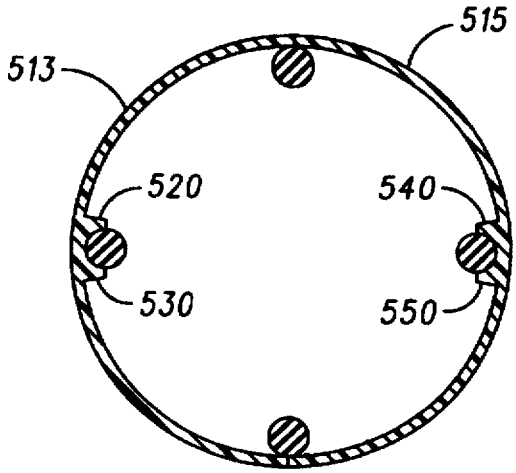
Figure 7:
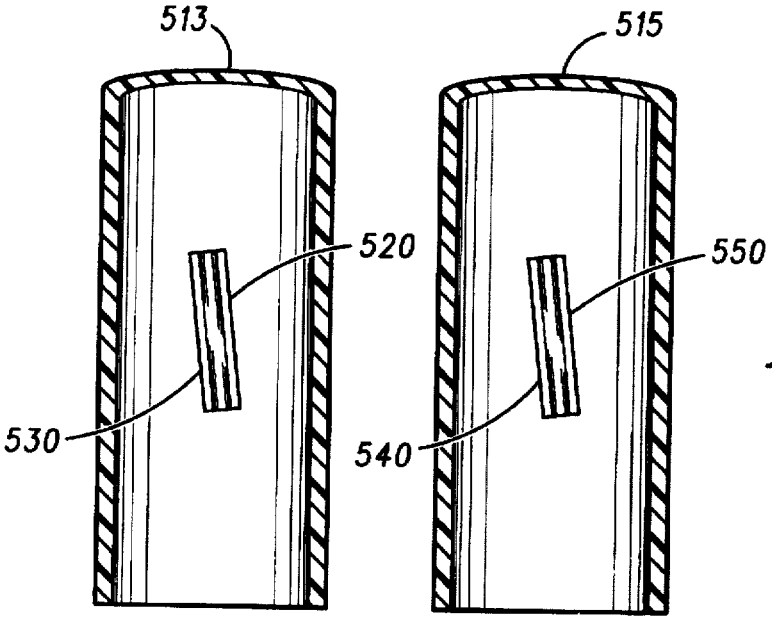

FIGS. 5–7 illustrate an alternative embodiment for housing the antenna element with dielectric according to the present invention. Instead of the arms alone supporting the dielectric members, the radome itself supports the dielectric members. Dielectric members 520, 530, 540 and 550 preferably are molded into respective radome sides 513 and 515. The radome has two sides 513 and 515 in one embodiment. Making the radome out of the two sides 513 and 515 facilitates assembly of the antenna element inside the radome between the dielectric members 520, 530, 540 and 550. To support the dielectric members from the radome, the dielectric members are preferably molded into the same material as the material of the radome. Other than the illustrated square-like shape, the dielectric members 520, 530, 540 and 550 can have different shapes to facilitate practical manufacture.

The dielectric collars 150 and 160 or dielectric members 520, 530, 540 and 550 preferably touch the arms to mechanically support the antenna element. Nevertheless, the dielectric collars 150 and 160 or dielectric members 520, 530, 540 and 550 can be adjacent to the antenna element without touching the arms. Placing the dielectric adjacent to the arms without touching still allows self phasing of the antenna element but avoids the advantages of mechanical support.

The dielectric collars 150 and 160 or dielectric members 520, 530, 540 and 550 preferably touch the arms to mechanically support the antenna element. Nevertheless, the dielectric collars 150 and 160 or dielectric members 520, 530, 540 and 550 can be adjacent to the antenna element without touching the arms. Placing the dielectric adjacent to the arms without touching still allows self phasing of the antenna element but avoids the advantages of mechanical support.

Figure 8:
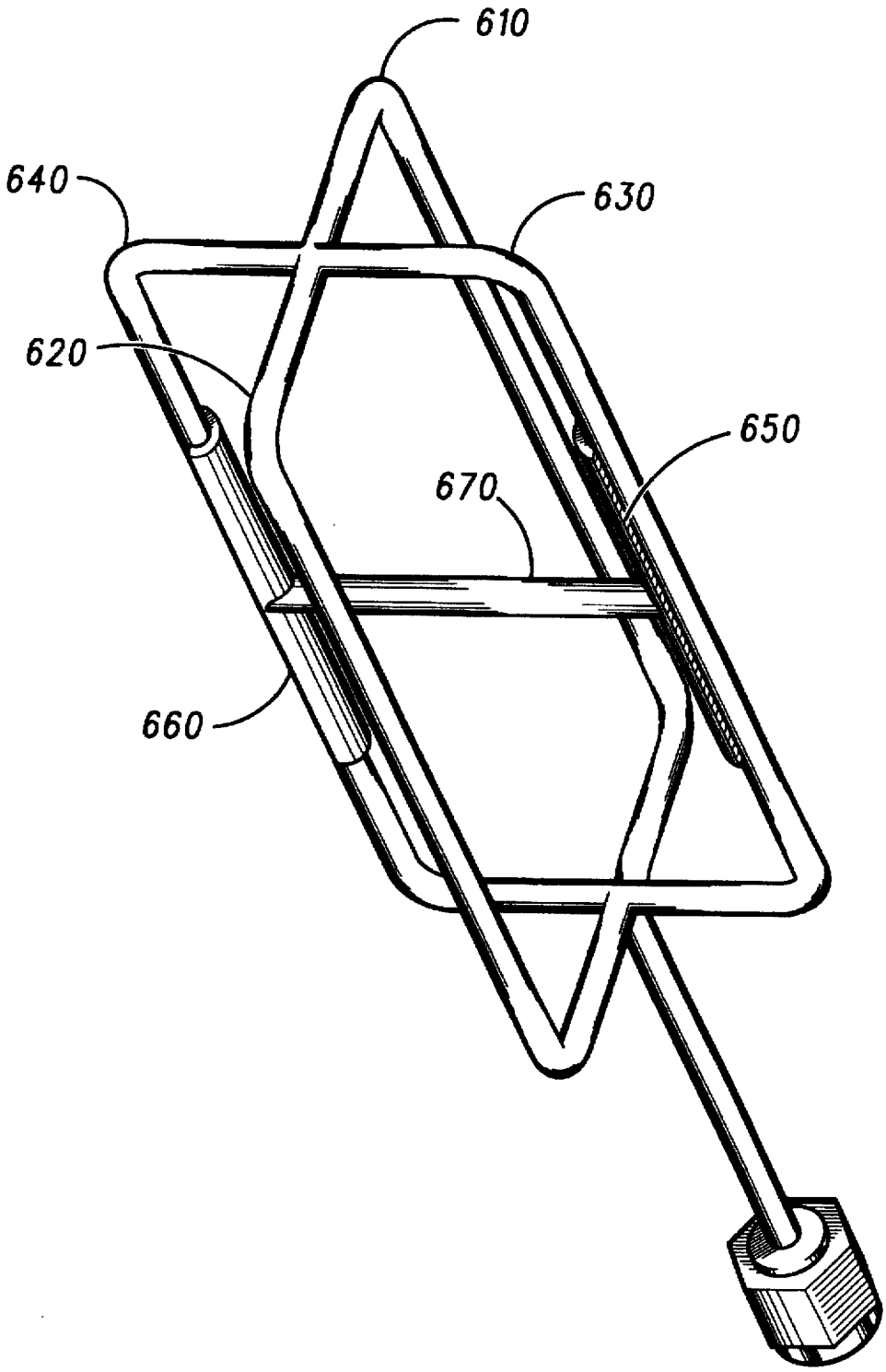
FIG. 8 illustrates a perspective view of a crossed loop antenna element with dielectric according to the present invention.

FIG. 8 illustrates a perspective view of a crossed loop antenna element with dielectric according to the present invention. A crossed loop antenna is structurally similar to a quadrifilar helix antenna except the two loops are not twisted. The crossed loop antenna element has four arms 610, 620, 630 and 640. A first pair of the arms 610 and 620 forms a first loop and a second pair of the arms 630 and 640 forms a second loop. A dielectric 650 and 660 is provided adjacent to the arms of one of the two loops.

Although the invention has been described and illustrated in the above description and drawings, it is understood that this description is by example only, and that numerous changes and modifications can be made by those skilled in the art without departing from the true spirit and scope of the invention. Although the above drawings depict only one antenna element, an array of antenna elements can be implemented in an antenna. The present invention is not limited to portable electronic radios such as radiotelephones and pagers but can be applied to other devices such as ground stations, fixed satellite telephone booths, and aircraft and marine stations. Further, the principles of the present invention are applicable to satellite as well as terrestrial based communications.

What is claimed is:

1. A self phased antenna element for transceiving a signal having a resonant frequency, said antenna element comprising:

a first conductive loop; and a second conductive loop operatively connected at a feed point of excitation and disposed in a crossed relationship with the first loop, wherein a physical length around a perimeter of the first loop is essentially the same as a physical length around a perimeter of the second loop; and a selective amount of dielectric material at a position adjacent to at least a portion of the first loop, wherein the amount of dielectric material is at a position adjacent to the first loop to cause at a resonant frequency an electrical length of the first conductive loop to be longer than an electrical length of the second conductive loop and a self phased relationship between the first conductive loop and the second conductive loop wherein phases of currents in the first conductive loop and the second conductive loop are spaced 90 degrees from one another.

2. An antenna element according to claim 1, wherein said dielectric material is of a type and is of dimensions having characteristics to cause the self phased relationship at the resonant frequency.

3. An antenna element according to claim 1, wherein said selective amount of dielectric material comprises a partially-encapsulating collar wrapped around the portion of said first conductive loop.

4. An antenna element according to claim 1, said selective amount of dielectric material is formed by at least one partially-encapsulating collar facing an inside of the first loop.

5. An antenna element according to claim 1, wherein said selective amount of dielectric material comprises a first partially-encapsulating collar adjacent to a first arm of the first conductive loop and facing an inside of the first conductive loop; and a second partially-encapsulating collar adjacent to a second arm of the first conductive loop and facing an inside of the first conductive loop.

6. An antenna element according to claim 5, wherein said selective amount of dielectric material further comprises a truss member disposed between said first and said second collar to provide support.

7. An antenna element according to claim 1, wherein said antenna element further comprises a radome disposed about an outer perimeter of said first and second loops; and wherein said selective amount of dielectric material is provided on an inside surface of said radome.

8. An antenna element according to claim 7, wherein said selective amount of dielectric material comprises a dielectric collar on an inside surface of said radome.

9. An antenna element according to claim 7, wherein said selective amount of dielectric material is integral to the radome at an inside surface thereof.

10. An antenna element according to claim 1, wherein said first and second conductive loops form twisted loops crossed to form a quadrifilar helix antenna element.

11. An antenna element according to claim 1, wherein said crossed first and second conductive loops form a crossed loop antenna element.

12. A method of making a self phased antenna element having first and second conductive loops of essentially the same physical length around their perimeters and operatively connected at a feed point of excitation and disposed in a crossed relationship with one another to transceive a signal having a resonant frequency, said method comprising the steps of:

(a) selectively disposing an amount of a dielectric material in a position adjacent to at least a portion of said first conductive loop; and (b) adjusting a position of the dielectric material with respect to the first conductive loop at the resonant frequency to cause an electrical length of the first conductive loop of the antenna element to be longer then an electrical length of the second conductive loop and a self phased relationship to occur wherein phases of currents in the first conductive loop and the second conductive loop are spaced 90 degrees from one another.

13. A method according to claim 12, wherein said step (b) of adjusting comprises the substep of (b1) sliding a dielectric collar along a length of the first loop to adjust the position and cause the self phased relationship.

14. A method according to claim 12, further comprising the step of (c) supporting at least two arms of the first loop between a truss member of the dielectric material during assembly.

* * * * *